US005456375A

United States Patent [19]

May

[11] Patent Number: 5,456,375

[45] Date of Patent: Oct. 10, 1995

[54] TAMPER EVIDENT CAP AND CONTAINER

[75] Inventor: John P. May, Melbourne, Australia

[73] Assignee: Specialised Purchasing Concepts Unit Trust, Melbourne, Australia; Specialised Packaging Concepts Pty. Ltd., Trustee

[21] Appl. No.: 886,075

[22] Filed: May 20, 1992

[51] Int. Cl.[6] ..... B65D 41/34

[52] U.S. Cl. ..... 215/252; 215/256; 215/321; 220/276

[58] Field of Search ..... 215/252, 253, 215/254, 256, 258, 321, 344; 220/290, 276

[56] References Cited

U.S. PATENT DOCUMENTS

| | | | |
|---|---|---|---|
| 4,322,912 | 3/1982 | Conti . | |
| 4,346,811 | 8/1982 | Hilaire . | |
| 4,380,299 | 4/1983 | Llera . | |
| 4,401,227 | 8/1983 | Pehr . | |
| 4,436,212 | 3/1984 | Llera . | |
| 4,458,820 | 7/1984 | Abrams . | |
| 4,729,488 | 3/1988 | Bullock, III . | |
| 4,805,792 | 2/1989 | Lecinski, Jr. . | |
| 4,886,175 | 12/1989 | Schlaudecker | 215/32 |
| 4,934,546 | 6/1990 | Markley . | |
| 4,936,474 | 6/1990 | Szczesniak, et al. . | |
| 4,936,475 | 6/1990 | Montgomery | 215/252 |
| 4,974,735 | 12/1990 | Newell, et al. . | |
| 5,009,323 | 4/1991 | Montgomery et al. . | |
| 5,012,941 | 5/1991 | Abrams, et al. . | |
| 5,050,754 | 9/1991 | Marino . | |
| 5,076,453 | 12/1991 | Odet . | |

*Primary Examiner*—Stephen J. Castellano

*Attorney, Agent, or Firm*—Steven G. Roeder; Sheldon & Mak, Inc.

[57] ABSTRACT

A cap and container combination wherein the cap fits about the container in at least two closure positions. Two circumferential bands are provided around the skirt of the cap and there is an internal thread which engages an external thread about the container neck. In the first position, one band of the cap engages a circumferential slot about the container. The internal thread seals with the top of the container. The first band is removed and the container opened by removing the cap. In the second position, the second band engages the slot and the threads engage each other. In the second position, the second band is located about the container. It remains in position when and after the cap is removed. Tampering of the container and cap can be visually detected with this configuration. A bead about the container is formed of a reduced cross-section in portions circumferentially around the cap. This facilitates assembly and disassembly of cap and container.

20 Claims, 7 Drawing Sheets

FIG. 10
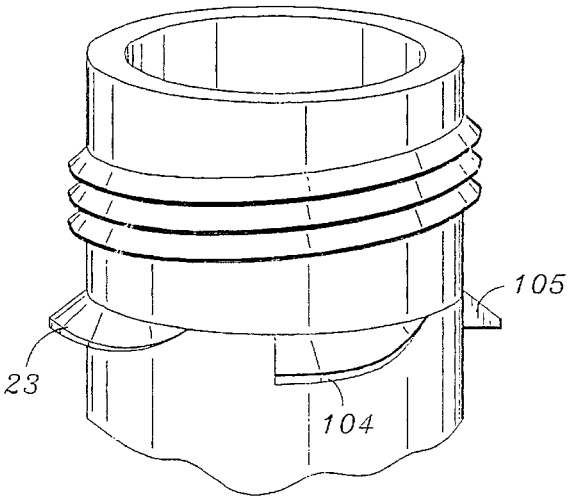
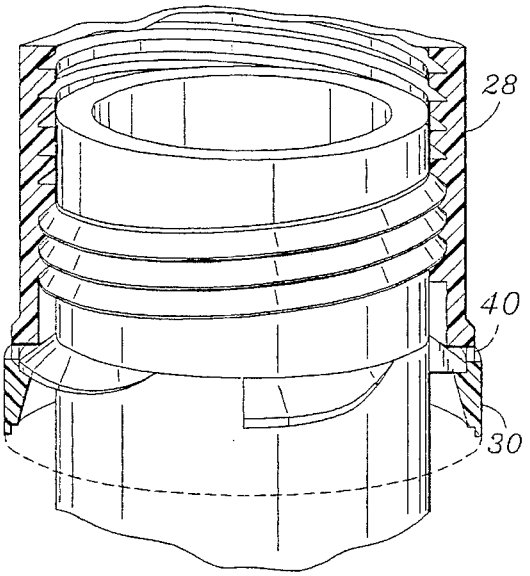
FIG. 11
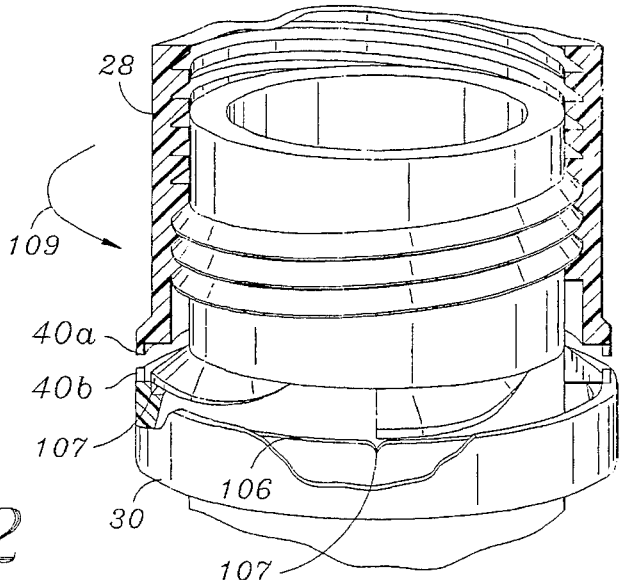
FIG. 12

TAMPER EVIDENT CAP AND CONTAINER

BACKGROUND

Cap-container configurations which are tamper proof are increasingly important for modern society. This is particularly the case where the container is to contain medical samples or medical products.

This invention relates to a tamper evident cap and container, particularly for sample and specimen collections for medical purposes.

Different kinds of cap-container combinations are known. Unfortunately most of these do not provide easy use to the medical laboratory technicians or patients. Moreso, they are also generally relatively complex to manufacture. Evidence of tampering can often be disguised in many of the known cap-container configurations.

There is a need to provide a tamper evident cap-container which minimizes drawbacks in such known configurations.

SUMMARY

By the present invention there is provided a dual operation cap-container which is a considerable improvement over known tamper proof configurations.

According to the invention a cap includes a top face and a skirt and a container includes a neck and a mouth. The cap is receivable on the container in at least two different closure positions with the skirt over the neck. The cap has a first band and a second band, the bands being circumferentially arranged around the skirt. Above the second band there is an internal threaded formation which engages an externally threaded formation about the neck of the container.

Engagement is affected when the cap is mounted on the container. In a first position the first band is located in the slot and the internal threads of the cap engage the rim about the neck of the container to affect a sealing relationship. In the second closure position, the second band is located in a slot below the external threaded formation around the container.

The first band is removable from the cap. The second band can then engage the slot. A line of weakness located between the first band and the second band permits for the easy removal of the first band from the skirt. The second band is also removable from the skirt of the cap. This is achieved by unthreading the cap from the top of the container and leaving the second band located in position in the slot. This breaks connecting columns between the skirt and the second band.

The invention is further described with reference to the accompanying drawings.

DRAWINGS

Figure 9A:
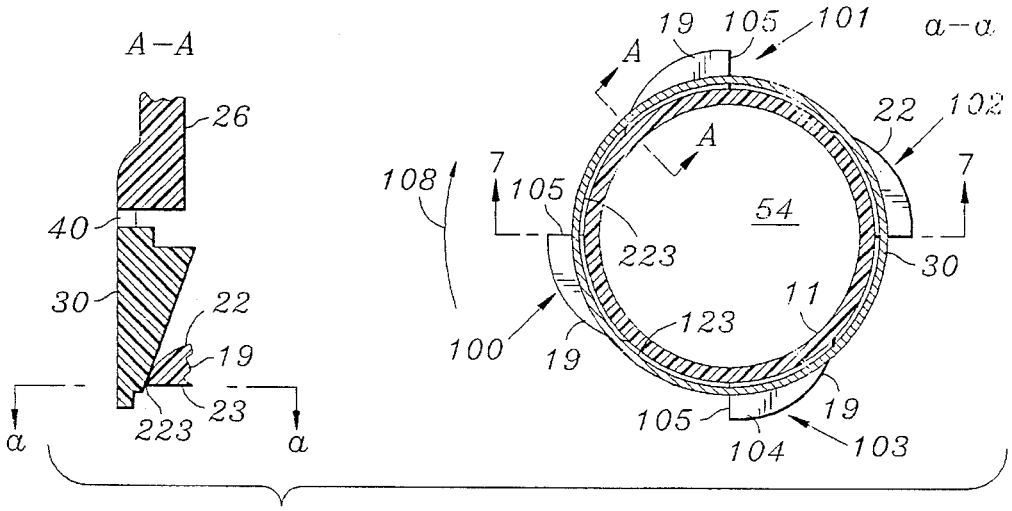

FIG. 9*a* is constituted by a pair of views: a partial side view A—A showing the interaction during engagement of the second band with the segmented bead, and secondly a cross-sectional top plan view a—a along lines a—a of the side view illustrating the circumferential bead about the container. In FIG. 9*a*, the second band is in a first position of engagement being urged onto the container.

Figure 9B:
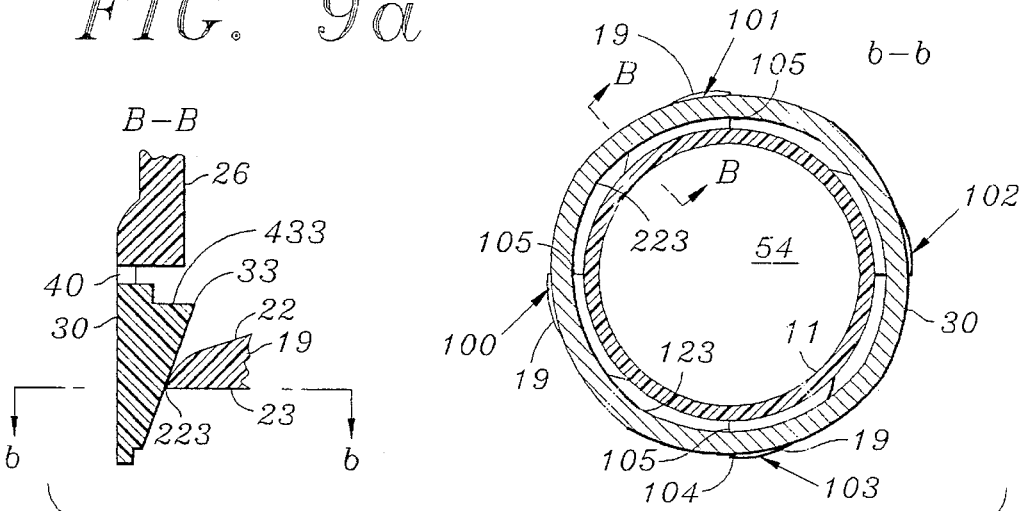

FIG. 9*b* is constituted by a pair of views: partial side view B—B showing the interaction during engagement of the second band with the segmented bead, and secondly a cross-sectional top plan view b—b along lines b—b of the side view illustrating the circumferential bead about the container. In FIG. 9*b*, the second band is in a second position of engagement being urged onto the container.

Figure 9C:
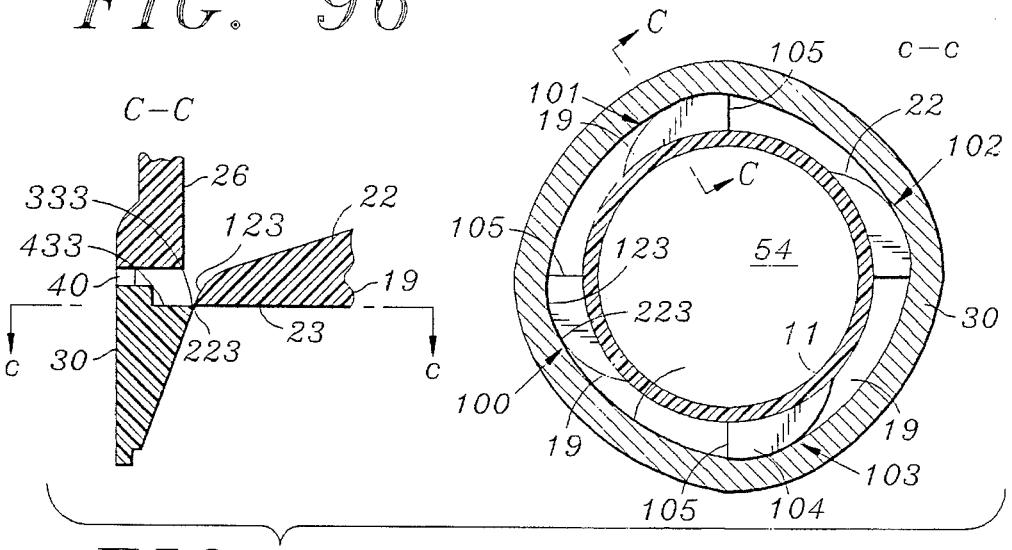

FIG. 9*c* is constituted by a pair of views: partial side view C—C showing the interaction during engagement of the second band with the segmented bead, and secondly a cross-sectional top plan view c—c along lines c—c of the side view illustrating the circumferential bead about the container. In FIG. 9*b*, the second band is in a third position of engagement being urged onto the container.

FIG. 10 is a perspective view illustrating the neck of the container and showing the segmented bead.

FIG. 11 is a perspective view of the neck of the container showing a partial view of the cap with the second band in location below the segmented bead.

FIG. 12 is a perspective view of the neck of the container showing a partial view of the cap with the second band separated from the skirt of the cap after which the cap is removed from the container.

Figure 13A:
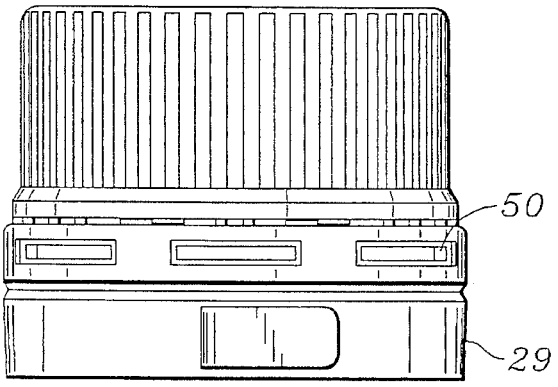
Figure 13B:
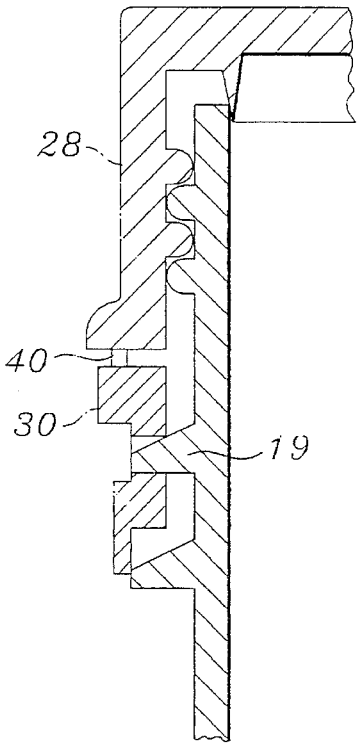
Figure 13C:
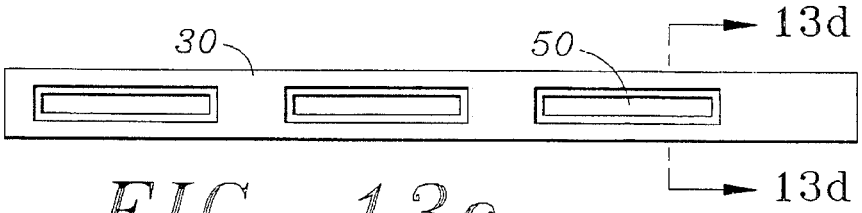
Figure 13D:
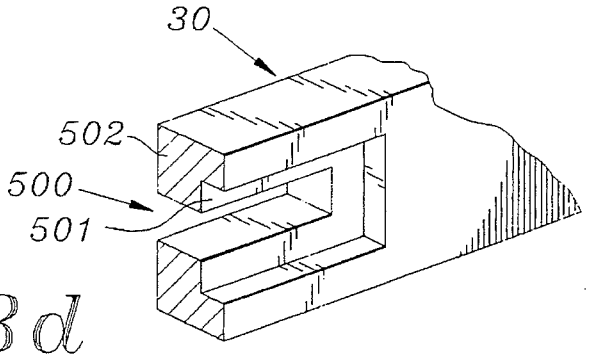

FIGS. 13*a* to 13*d* illustrate a different embodiment of a band with holes in place of an inset. FIG. 13*c* is an expanded view of the band 30. A detail of the hole is shown in the partial view of FIG. 13*d*. FIG. 13*b* is a partial cross-sectional side view and FIG. 13*a* is a side view of the cap.

DESCRIPTION

Figure 1:
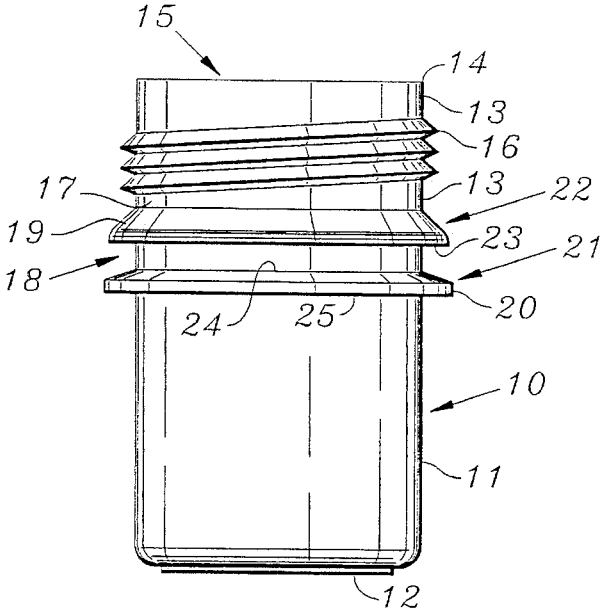
FIG. 1 is a side view of the container.
Figure 2:
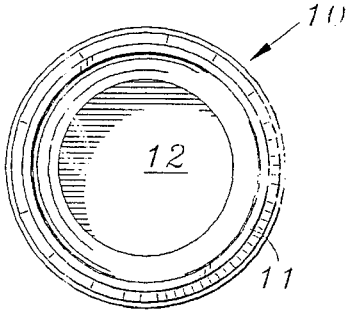
FIG. 2 is a top view of the container.
Figure 3:
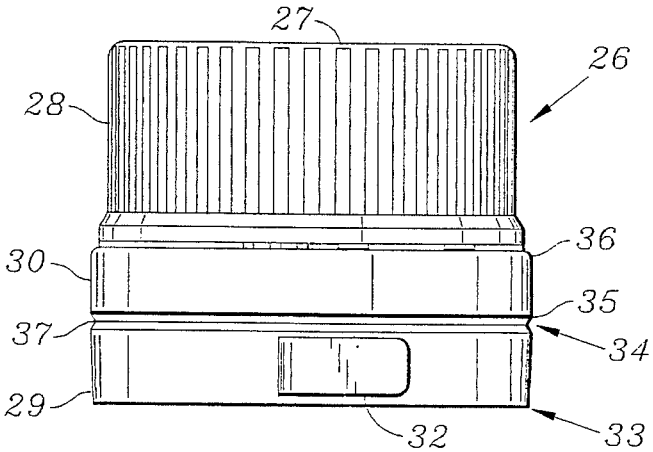
FIG. 3 is a side view of the cap.
Figure 4:
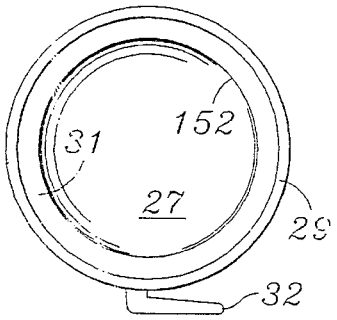
FIG. 4 is a under view of the cap.

In FIG. 1 there is shown a container 10 which is a cylindrical shaped construction which has a cylindrical side wall 11 and a bottom wall 12. There is a mouth 15 at the top of the container 10 adjacent to a neck area 13. The rim 14 for the container 10 is located between mouth 15 and the neck area 13.

A secondary engaging element 16 is constituted by a threaded portion which is provided about the neck area 13 of the container 10, below the mouth of 15 and adjacent with the rim 14. Below the threaded portion 16 of the neck 13 there is a flat wall area 17 followed by a primary engaging element 18. This primary engaging element 18 is constituted by a circumferentially extending bead 19 and a circumferentially extending ring 20. Between the bead 19 and the ring 20 there is a slot 21 circumferentially extending around the wall 11.

The bead 19 includes a bevelled edge 22 which slopes towards the mouth 15 of the container 10. The wall 23 opposite to the bevelled edge 22 is substantially rectangularly directed relative to the surface of the wall 11. A bevelled edge 24 on ring 20 also tapers towards the slot 21. A right-angular wall 25 of ring 20 is located on the opposite side of the ring 20 and is directed to wall 11.

A cap 26 is constituted by a top face 27 and a skirt 28 depends from the top face 27. Below the skirt 28 there is a first engaging means, being a first band 29, and a second engaging means, being a second band 30. Internally, inside the skirt 28, there is a third engaging means, being an internal threaded portion 31. The first band 29 includes a pull tab 32. Band 29 tapers circumferentially inwardly so that at the leading end 33 the diameter of band 29 is narrower than at the end 34. The band 30 is substantially straight circumferentially so that the ends 35 and 36 of the band 20 are circumferentially substantially the same. A line of weakness 37 exists between the band 29 and the band 30.

Between the band 30 and the skirt 28 there are circumferentially arranged dogs 38*a* and 38*b*. Dog 38*a* depends downwardly from end 41 of the skirt 28 and dog 38*b* depends upwardly from the end 39 of the band 30. The dogs 38*a* and 38*b* are assembly drive dogs which prevent tearing of tear columns 40 located between the end 39 and the end 41 of the skirt 28. At least one additional support column 42 is provided to depend from the end and this extends partly towards the end 39 of the second band 30.

Figure 5:
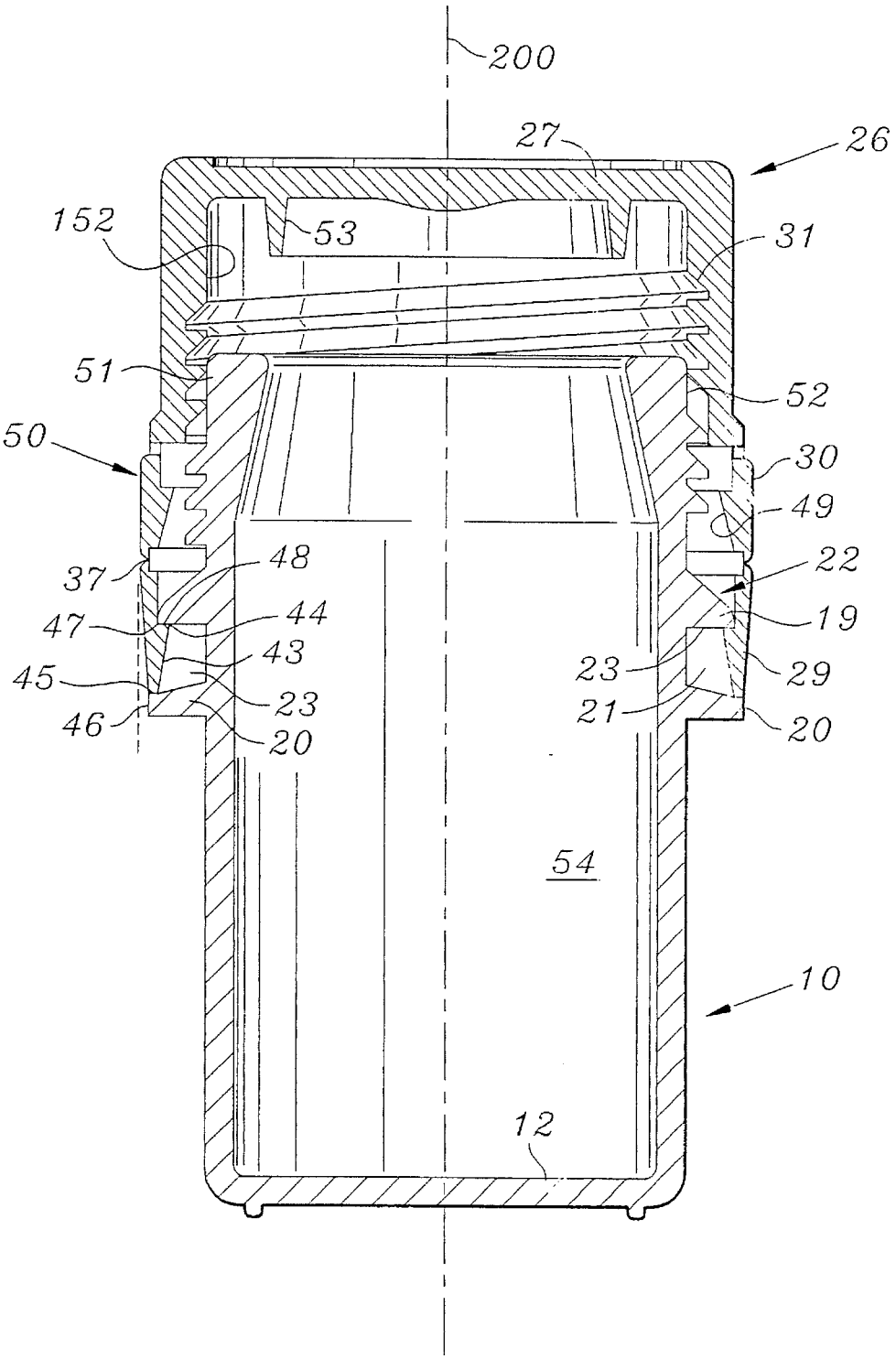
FIG. 5 is a cross-sectional side view of the container with the cap in a first position.

The band 29 includes a circumferentially inwardly directed inset 43 which tapers inwardly and upwardly to a narrower diameter 44. Thus the band 29 is narrower at a position closer to the face 27 of the cap 26 than at the leading end 33 of cap 26. The outside end 45 of the band 29 is dimensioned to meet with the end 46 of the ring 20 so that when located as indicated in FIG. 5 the relationship between end 45 and end 46 is flush. A lip 47 is also provided midway along the inner tapered inset 43 of the band 29. The lip 47 engages the straight portion of wall 23 of the slot 21 at position 48.

The band 30 includes an inwardly directed inset 49 which is also directed to be located at least partly in the slot 21 when the band 30 is in the position between the walls 19 and 20 of slot 21. The outside surface 50 of band 30 protrudes beyond the edge 46 of wall 20 of slot 21.

The bead 19 is segmented into four portions 100, 101, 102 and 103 which extend from the wall 11 radially outwardly. Segmentation allows the bands 29 and 30 to distort from their circular form across the high points of the bead 19, namely at the interface of edge 22 and wall 23, as they are forced over the bead 19. Each segment has a radially increasing ramp-type outer face 104 which ends in sharp cut-off face 105.

By having the bead 19 formed in this manner, then the amount of undercut, namely depth of wall 23 relative to insets 43 and 49, is significantly increased. As such, an increased force is required in assembling the cap, namely locating bands 29 and 30, respectively, in position over bead 19. This also increases the effectiveness to determine the evidence of tampering. The increased distance of the relative distance undercut or overlap 23 and insets 43 and 49, reduces the force required during assembly.

The bead 19 is formed with segmented portions, namely with areas of full radius and depth, and with areas of lesser or no radius or depth. As illustrated in FIGS. 9*a*, 9*b*, 9*c*, 10, 11 and 12, the four segments 100, 101, 102 and 103 have leading edges 104 of each of the segments 100 to 103. Such edges 104 are radiused to allow for ease of cap assembly between the mating edges of bead 19 and bands 29 and 30. In each of the two engagement steps, respectively, the bands 29 and 30 are under tension as the undercut or inset 43 of band 29 and inset 49 of band 30 is forced over the band 19. The distorted position of band 30 is illustrated progressively in FIGS. 9*a* to 9*c* during assembly or engagement of the band 30 over bead 19 as the cap 26 is turned into the container 10 in the direction of arrow 108.

In FIG. 9*a*, the band 30 is essentially a regular circle as band 30 commences engagement of the outer rounded edge 123 between the edge 22 and wall 23. Edge 123 forms a line of contact which commences at a contact point 223 at the leading edge of segments 100, 101, 102 and 103. This acts as the beginning of a wedging action to commence prizing the band 30 to a wider diameter as the cap is urged further into engagement with the container.

In FIG. 9*b*, the increased outward distortion is illustrated. As shown in FIG. 9*b* with view b—b, the point of contact 223 has moved further along the ramp leading edge 104 of each segment 100 to 103. Further, in FIG. 9*c*, the contact point 223 has moved further radially outwardly as seen in view c—c.

Figure 6:
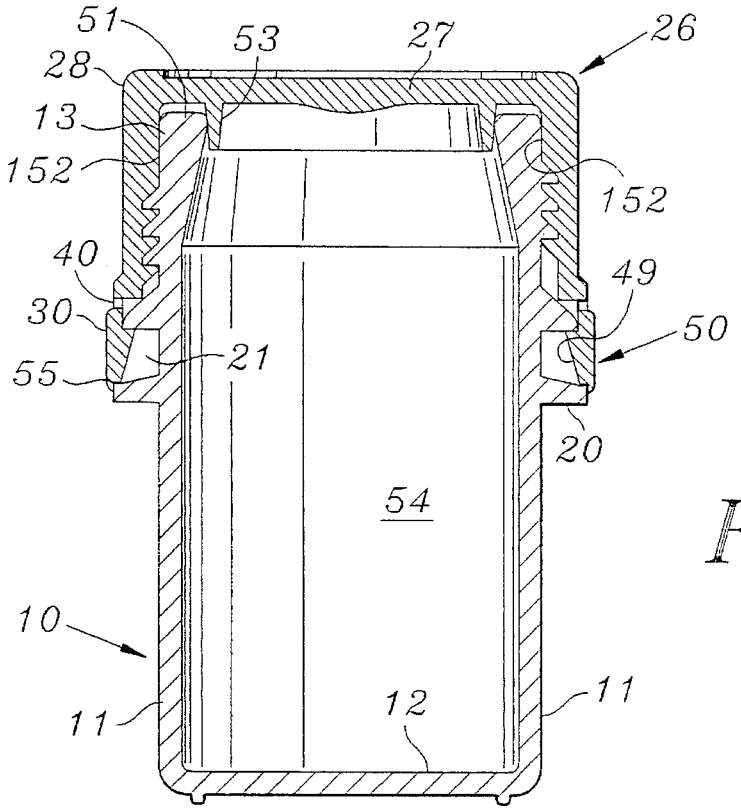
FIG. 6 is a cross-sectional side view of a cap in a second position.

The contact point 223 is in point to point contact with the inner radial point edge 333. As the cap is screwed down further, the band 30 will slip under wall 23 as it contracts radially. The position will be as shown in FIG. 6. The same assembly characteristics are effective with band 29 when it engages band 19.

During cap removal, the sharp drop-off at edge 105 further assists in breaking away the band 30. This is illustrated in FIGS. 10, 11 and 12. The sharp drop-off face 105 assists in breaking the band 30 when the cap 26 is unscrewed as indicated by arrow 109. The band 30 is pulled upwardly during this action and the top face 433 of band 30 engages the sharp edge drop-off created by the edge 105 which is right angularly directed relative to the outside surface of the wall of container 10. As such, the edge is substantially radially directed relative to the central axis 200 through the container 10. The upward moving band 30 comes in contact with the right angle face 105 at the radially outer edge area 106 and this bites into the top face 433 of band 30. The band 30 becomes stationary and the cap 10 continues to move upward thus breaking the band 30 at tear columns 40 into components 40*a* on skirt 28 and 40*b* on band 30. In most cases, the band 30 rides along the bead 19 until there is enough upward pressure and circumferential interference about the circumference of the band 30 for breaking the tear columns 40 to band 30. The biting creates radial nicks or lines 107 at about the four spaced locations where face 105 digs into the top 433 of band 30.

In other forms of the invention, there could be more or less segments 100 to 103, and the shape and cross-section of the segments 100 to 103 could vary as necessary. The elimination of material from the bead by providing segments permits for a relatively rigid plastic, such as polypropylene, preferably of the randon copolymer-type material constituting the cap and container to stretch or distort more easily for assembly. The segments 100 to 103 have a cord length which is a circumferentially directed portion, and also a ramped circumferential portion. By varying the cord length and ramp length in different constructions, different degrees of force would be applicable for different embodiments to apply and remove the cap from the container.

Moreover, in other forms of the invention as illustrated in FIGS. 13*a* to FIGS. 13*d*, there is shown an embodiment where the band 30 is constructed with circumferentially spaced holes 500. Such holes 500 would interact with a segmented bead 19. Such a construction would avoid an inset 49. The shape of the holes 500 is rectangular to mate with the segments 100 to 103, and has a step 501 in the body 502 of band 30.

The top of the wall 11 constituting the neck 13 is thickened section 51 which is directed inwardly into body portion 54 of the container. The outside surface 52 is substantially straight and parallel with the side wall 11 of the container 10. The cap 26 includes an interface wall 152 and a wedging ridge 53 which forms a circumferential seal with the interface wall 152. When cap 26 is located as indicated on the container 10 as indicated in FIG. 6, the thickened section 51 of the neck 13 is forced between the ridge 53 and inside face 152 of the skirt 28 of the cap 26. This affects a sealing of the cap 26 with the container 10.

Figure 7:
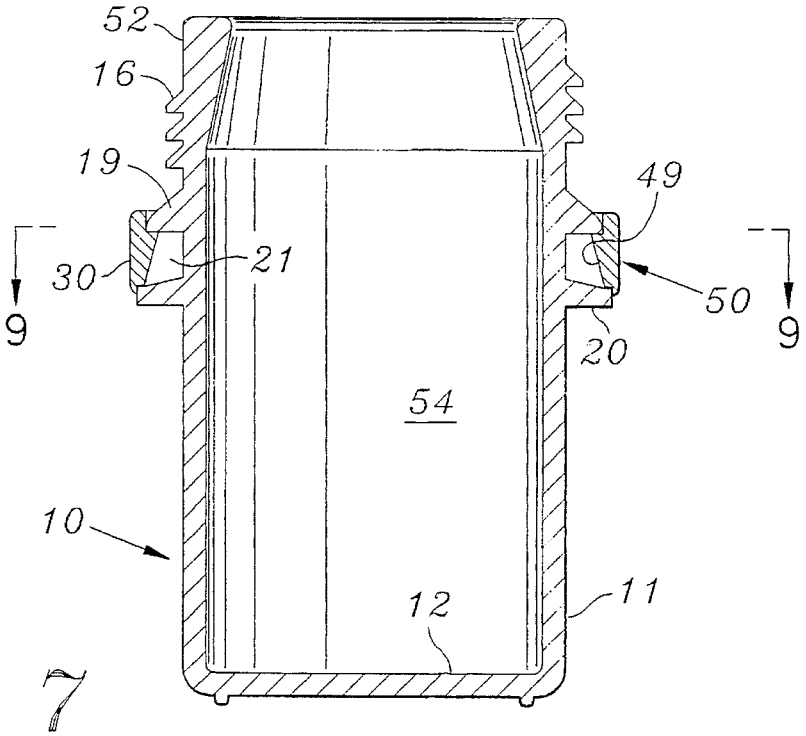
FIG. 7 is a cross-sectional side view of the container with the second band in position around the slot of the container.
Figure 8:
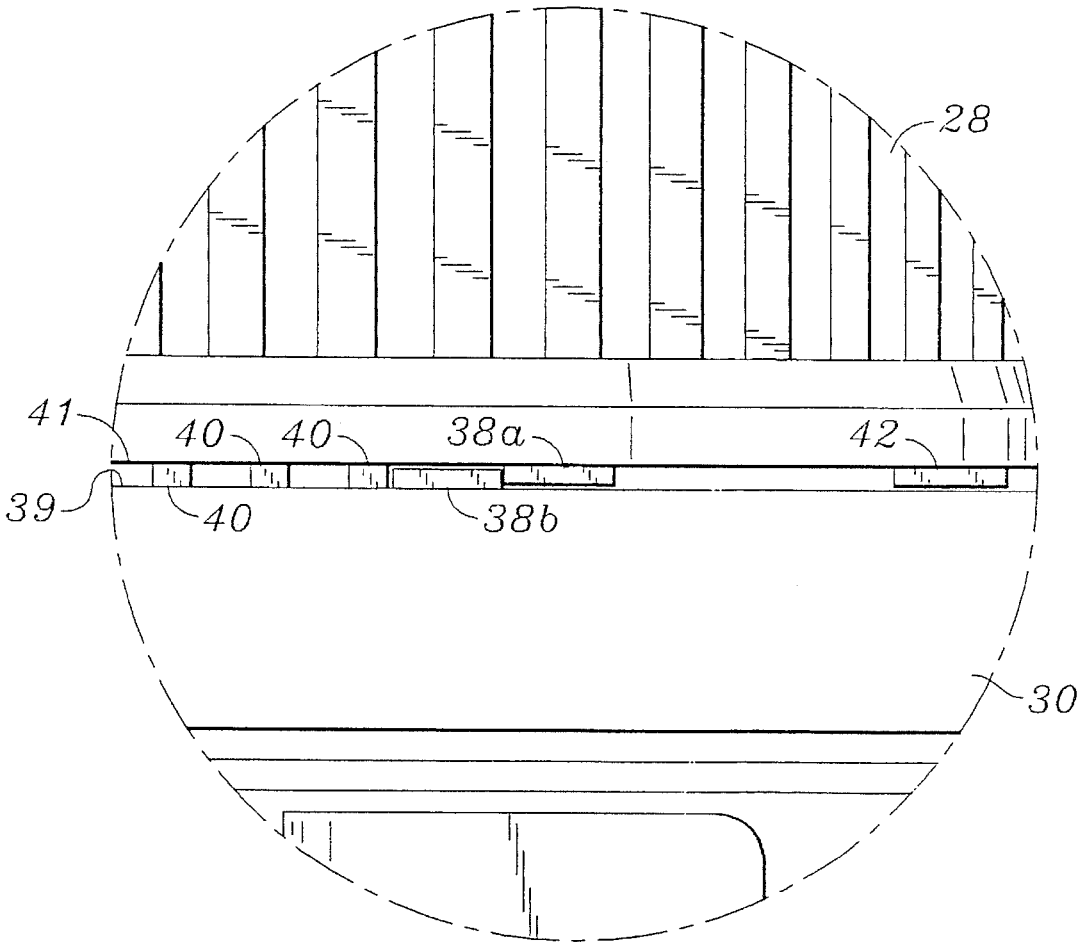
FIG. 8 is a enlarged view of a portion of the cap showing the interface between the band and the skirt containing the internal threaded section.

In operation of the container-cap configuration is illustrated in FIG. 5 to 7 with the cap 26 located on the container 10.

In the first closure position illustrated in FIG. 5, the cap 26 is force pushed onto the mouth 15 of the container 10. The band 29 fits in slot 21. The flush location between the points 45 and 46 prevents tampering of the cap-container configuration in this manner. Any tampering could be seen by a deformation of the ring 20 or band 29 at the interface at points 45 and 46. At this position the internal threads 31 of cap 26 engage with the outside 52 of the thickened portion 51 about the mouth 15 above the neck 13. This provides a seal between the cap 26 to the interior 54 of the container 10. Moving into the first closure position, the tapered inside edge 43 of band 29 can ride easily over the bevelled edge 22 of the wall 19.

In the second closure position, the cap 26 is moved downwardly and the threads 31 engage with the threads 16 on the outside of neck 13. The cap 26 is turned as it moves downwardly. Before the cap 26 is urged into the second closure position, the pull tab 32 of band 29 is pulled and the band 29 is removed. The cap 26 is then turned and is pushed into the second closure position. The pulling of the pull tab 32 causes the first band 29 to be removed from the second band 30 along the line of weakness 37. This facilitates the manner by which the cap 26 can be urged downwardly onto the container 10.

The second closure position can be adopted after the cap 26 has been removed from the first closure position and the contents of the container 10 filled with a sample. Once it is desired to add a sample to the container 10, the cap 26 is removed from the container 10 by separating the band 29 under the action of the pull tab 32. The cap 26 is removed, the sample is placed into the body area 54 of the container 10. The cap 26 is then replaced so that the band 30 fits into slot 21. Any attempt to unscrew the cap 26 would cause the band 30 to separate from the skirt 28.

After that time, and the removal of the band 29, the cap 26 is urged into the second closure position with the band 30 in engagement in the slot 21. The bevelled insert 49 can slide over the bevelled edge 22 of wall 19. The container-cap can then be shipped to any desirable place.

In the second position, illustrated in Figure 6, the band 30 is in location in and adjacent to slot 21. In this position the sealing is affected between the wedging neck 13 and wall 52 together with the thickened section 51 and interface wall 152.

The band 30 protrudes circumferentially from the edge 46 of the wall 20. An internal shoulder 55 on the inside of band 30 engages the inside wall 20 of the slot 21.

Any tampering with the container 10 results in a physical deformation of band 30 or wall 20 which should be a visibly noticed. Also any tool which is used in an attempt to pry open a space between the free end of the circumferential band 30 adjacent to the shoulder 55 and the edge of wall 20 should result in a jamming effect of the wall against the shoulder 55. Thus, prying open of the band 30 cannot easily be affected with this construction.

The pull tab 32 occupies essentially the entire distance between bead 19 and ring 20. This facilitates effective removal of the band 29 from band 30 along tear line 37. Essentially the band 29 when located in slot 21 occupies the entire distance between the inside 23 of wall 20 and inside 24 of the wall 25. Similarly the band 30 would fully occupy this distance. This facilitates sealing of the cap 26 on the container 10 and also prevents or hinders unauthorized tampering.

When the cap 26 is in a location as indicated in FIG. 5 the interface of edges 45 and 46 prevents further collapsing action between the cap 26 and container 10 if the cap 26 was to be pushed further onto the mouth 15 of the container. The ring 20 effectively prevents this further downward movement. Any illegal tampering with the container-cap at this stage to get access to the internal body area 54 of the container 10 would require the partial or complete separation of the bands 29 and/or 30 from the skirt 28. Such tampering should be visually evident.

At a different time, the cap 26 can be removed by unscrewing the skirt portion 28 from the band 30. This would leave the band 30 located in the slot 21 as indicated in FIG. 7.

The support columns 42 prevent the collapse of the cap 26 during assembly into the first closure relationship shown in FIG. 5. When the cap 26 is pushed onto the mouth 15 of the container 10 the skirt 28 does not compress and jam against the band 30 in a manner making the cap 26 inoperative. The alternately located dogs **38*a* and 38*b* are assembly drive dogs. The dogs prevent the tear columns 40, which are spaced circumferentially between the portions 28 and 30, from breaking when the cap 26 is screwed into position during the stage between that illustrated in FIG. 5 and that in FIG. 6**.

The tear columns 40 would be damaged when there is an attempt to unscrew the skirt 28 from the threaded engagement prior to the time that the cap 26 and the container 10 configuration is put into the stage indicated in FIG. 7. Thus any damage to these tear columns 40 would be evidence of tampering indicates access to the container which, depending on the stage of use of the container, would indicate possible illegitimate access to the container.

Many other forms of invention exist each differing from the other in matters of detail only.

The cap 26 is indicated to be a push fit with the rim 14 about the mouth 15 of the container 10. In a variation the threads 16 on the outside surface of the container 10 engage with the internal threads 31 on the cap 26 during the first closure position. This can be achieved by making the threads 16 and/or threads 31 extend over a greater longitudinal distance relative to the container 10.

In some other embodiments of the invention it is unnecessary to have the external threads 16 on the container or internal threads 31 on the cap 26. The tamper proof features are effectively achieved by the bands 29 and 30 engaging with the slot 21 in the different operational closure positions. Thus in a first closure position, the first means and the primary engaging element is operable. In a second closure position, the second means and the primary engaging element is operable. In the position where the cap 26 is removed, the second means is separated from the cap. The threaded configuration 16 and 31 is not essential to effect the tamper proof characteristics. Threads 16 and 31, preferably do provide for positive engagement in at least the second closure position.

Different cross-sections can be used for the bands 29 and 30 as required. For instance, instead of walls which are substantially regular on the outside surfaces, it may be desirable to have the wall thickness be directed radially inwardly, thereby being of a substantially constant thickness. The outside and inside walls of the bands 29 and 30 would thereby be substantially parallel at least over discrete portions of the height.

In other cases, at least one of the bands 29 or 30 may be partly circumferential about the cap. Thus, one or other of the bands could have segments having a ramp-type profile. This could be in place of the ramp-type segment profiles of bead 19, or in addition to such segments 100 to 103 of bead 19.

Other applications of the invention are in a area not related to security for the container cap configuration. Such applications would be where evidence of tampering is not needed. These would be, for instance, the beverage industry or many other industries where improved cap and container configurations and interactions are required.

The invention is to be determined solely in terms of the following claims.

I claim:

1. An article comprising a cap and a container, the container including a neck and a mouth, and the cap including a top face and a skirt and wherein the cap is receivable on the container in at least two different closure positions with the skirt over the neck; the cap having a first engaging means and a second engaging means, and the container having a primary engaging element; wherein in a first closure position, the primary engaging element and the first engaging means interact and in a second closure position, the primary engaging element and the second engaging means interact;

wherein (i) the cap includes a third engaging means, (i) the container includes a secondary engaging element, and (iii) the secondary engaging element and the third engaging means interact in the second closure position;

wherein (i) the secondary engaging element includes an external threaded surface about the neck of the container, and (ii) the third engaging means includes a corresponding internal threaded surface for location external to the external threaded surface in the secondary closure position.

2. The article as claimed in claim 1 wherein (i) the primary engaging element includes a circumferential slot about the neck of the container, (ii) the first engaging means includes a circumferential first band depending from the skirt, and (iii) the second engaging means includes a circumferential second band located between the first engaging means and the third engaging means.

3. The article as claimed in claim 2 wherein (i) the slot includes a circumferentially extending bead located adjacent and below the secondary engaging element and a circumferential extending ring spaced below the bead and (ii) the bead includes a bevelled edge, the bevelled edge being directed towards the mouth of the container with a broader part of the bead is adjacent the slot.

4. The article as claimed in claim 3 wherein the bead includes a predetermined number of segments circumferentially about the container.

5. The article as claimed in claim 4 wherein the segments have (i) a ramp outer face, the ramp outer face extending from a position substantially adjacent an outer surface of the container to a position radially extended from the neck and (ii) a face section with an edge extending transversely from the neck and whereby the edge is adapted for engagement with the respective band in the cap thereby to facilitate separation of the band from the cap when the cap is unthreaded from the container.

6. The article as claimed in claim 2 wherein the first band includes a circumferentially internally directed inset for engagement with primary engaging element in the first closure position, and the second band includes a circumferentially internally directed inset for location in the slot of the primary engaging element in the second closure position.

7. The article as claimed in claim 6 wherein (i) the slot is formed by spaced apart upstanding circumferential walls and (ii) the internally directed insets include a bevelled surface directed towards a bottom of the skirt for location between spaced opposite upstanding walls of the primary engaging element in the first closure position.

8. The article as claimed in claim 1 wherein the third engaging means is located in contact with the mouth of the container when the first engaging means is in location with the primary engaging element, thereby to effectively seal the container with the cap.

9. The article as claimed in claim 1 wherein (i) the first engaging means and second engaging means are separable, and including a first circumferential line of weakness between the first engaging means and second engaging means, and separation being affected along the line of weakness by removal of the first engaging means from the cap, and (ii) the second engaging means and the top face of the cap are separable and including a second circumferential line of weakness between the second engaging means and the top face of the cap and separation being affected along the line of weakness by removal of the second engaging means from the cap.

10. The article as claimed in claim 1 wherein the cap includes an internally directed wedge seal formation inside the top face of the cap, the wedge seal formation acting with an internal wall of the skirt of the cap to receive a wall of the container in sealing location when the cap is in the second closure position thereby effectively sealing the closure.

11. The article as claimed in claim 1 wherein the primary engaging element includes a ring extending circumferentially outwardly such that when the first engaging means is in location in the primary engaging element, an outside perimeter of the first engaging means is substantially flush with an outside circumference of the ring.

12. An article comprising a cap and a container, the container including a neck and a mouth, and the cap including a top face and a skirt, and wherein the cap is receivable on the container in at least two different closure positions with the skirt over the neck; the cap having a first circumferential band about a free end of the skirt, a second circumferential band in adjacency with the first circumferential band, and internal threads adjacent the second band and below an internal face of the top face of the cap; the container having an external threaded surface on the neck of the container and in adjacency with the container mouth, and a circumferential slot below the external threaded surface, the slot being defined between spaced walls; wherein, in a first closure position, the first band is in engagement with the slot, and in a second position, the internal threads and external threads are in engagement and the second band is in engagement with the slot.

13. The article as is claimed in claim 12 wherein, (i) in the first closure position, the first band is located substantially flush with adjacent opposite walls forming the slot such that a substantially smooth outer surface is provided between the walls of the slot and the band, and (ii) in the second closure position when the second band is engaging the slot, the second band at least partly protrudes circumferentially beyond the outer surface of the walls of the slot.

14. The article as claimed in claim 12 wherein, (i) in the first closure position, the internal threads engage the wall adjacent the mouth of the container thereby providing a seal between the container and the cap and, (ii) in the second closure position, a portion adjacent the internal top face and the skirt, engages the mouth of the container thereby providing a sealing engagement, such engagement being affected by a wedging action whereby a formation of an internal ridge provided on the inside of the cap affects the seal.

15. The article as claimed in claim 12 wherein the first band is separable from the second band, and the second band is separable from the top face of the cap.

16. The article as claimed in claim 12 wherein the slot includes a bead positioned below the external threaded surface, the bead extending at least partly about the circumference, and the bead includes a predetermined number of segments circumferentially about the container, the segments have (i) a ramp outer face, the ramp outer face extending from a position substantially adjacent an outer surface of the container to a position radially extended from the neck and (ii) a face section with an edge radially directed relative to the neck and whereby the edge is adapted for engagement with the band in the cap thereby to facilitate separation of the band from the cap when the cap is unthreaded from the container.

17. The article as claimed in claim 16 wherein the second band includes a number of spaced apart slots corresponding to the segments for receiving the segments in the second closure position.

18. An article comprising a cap and a container, the container including a neck and a mouth, and the cap including a top face and a skirt, and wherein the cap is receivable on the container in at least one closure position with the skirt over the neck; the cap having a circumferential band about a free end of the skirt and internal threads adjacent the circumferential band and below an internal face of the top face of the cap; the container having an external threaded surface on the neck of the container and being in adjacency with the container mouth, and a circumferential slot below the external threaded surface, the slot being defined between spaced walls, the slot including a bead positioned below the external threaded surface, the bead includes (i) a predetermined number of segments having a ramp outer face, the ramp outer face extending from a position substantially adjacent an outer surface of the container to a position radially extended from the neck, and (ii) a face section with an edge extending transversely from the neck and whereby the edge is adapted for engagement with the band in the cap thereby to facilitate separation of the band from the cap when the cap is unthreaded from the container; wherein, in the closure position, the circumferential band is in engagement with the slot, the internal threads and external threads are in engagement;

wherein the circumferential band includes a circumferentially directed inset which includes a bevelled surface directed towards a bottom of the skirt for location between spaced walls of the slot in the closure position.

19. The article as claimed in claim 18 wherein the circumferential band includes a number of spaced apart slots corresponding to the segments for receiving the segments in the closure position.

20. The article as is claimed in claim 18 wherein, the circumferential band is located substantially flush with adjacent opposite walls forming the slot in the closure position such that a substantially smooth outer surface is provided between the walls of the slot and the band.

* * * * *